US007736499B2

(12) United States Patent
Chong et al.

(10) Patent No.: US 7,736,499 B2
(45) Date of Patent: Jun. 15, 2010

(54) DISPOSABLE SINK DRAIN STRAINER

(76) Inventors: Jessica Chong, 510 1st, Unit B, Palisades Park, NJ (US) 07650-1604; Haion Won, 13 Wellington Dr., Basking Ridge, NJ (US) 07920

( * ) Notice: Subject to any disclaimer, the term of this patent is extended or adjusted under 35 U.S.C. 154(b) by 81 days.

(21) Appl. No.: 12/284,568

(22) Filed: Sep. 23, 2008

(65) Prior Publication Data

US 2009/0025128 A1 Jan. 29, 2009

Related U.S. Application Data

(63) Continuation-in-part of application No. 11/440,760, filed on May 25, 2006, now Pat. No. 7,442,296.

(51) Int. Cl.
*B01D 35/02* (2006.01)
*E03C 1/26* (2006.01)

(52) U.S. Cl. ..... 210/163; 210/474; 4/290; 4/292

(58) Field of Classification Search ..... 210/163, 210/164, 474, 482; 4/286, 290, 292, 293
See application file for complete search history.

(56) References Cited

U.S. PATENT DOCUMENTS

| | | | | | |
|---|---|---|---|---|---|
| 1,081,434 | A | * | 12/1913 | Cote | 4/293 |
| 2,968,047 | A | * | 1/1961 | Stilborn | 4/295 |
| 3,484,016 | A | * | 12/1969 | Turner | 220/281 |
| 3,788,485 | A | * | 1/1974 | Bruning | 210/474 |
| 3,982,289 | A | | 9/1976 | Robbins | 4/292 |
| 4,045,351 | A | | 8/1977 | Peterson | 210/238 |
| 4,134,162 | A | | 1/1979 | Sharland et al. | 4/292 |
| 4,205,710 | A | | 6/1980 | Dunicz | 141/9 |
| 4,423,824 | A | * | 1/1984 | Varndell | 4/293 |
| 5,376,264 | A | | 12/1994 | Betancourt | 210/166 |
| 5,397,464 | A | | 3/1995 | Hannon | 210/163 |
| 5,535,455 | A | | 7/1996 | Liu | 2/287 |
| 6,303,032 | B1 | | 10/2001 | Genduso | 210/232 |
| 6,387,261 | B1 | | 5/2002 | Mojena | 210/315 |
| 6,418,568 | B1 | * | 7/2002 | Briggs et al. | 4/292 |
| 6,601,242 | B1 | | 8/2003 | Rebischke | 4/286 |

* cited by examiner

*Primary Examiner*—Christopher Upton
(74) *Attorney, Agent, or Firm*—Ernest D. Buff & Associates LLC; Ernest D. Buff; Margaret A. LaCroix

(57) ABSTRACT

A disposable drain strainer is removably received within a drain opening having an adjacent drain rim substrate. The strainer has a strainer portion, a ring portion, and a seal release mechanism. Top and bottom surfaces of the ring portion are adapted to sealingly engage the drain rim substrate. The seal release mechanism is integral with the ring portion, and facilitates release of the seal so that the strainer can be readily be removed from the sink and discarded. In one embodiment, the seal release mechanism comprises a tab. In another embodiment, the seal release mechanism comprises a press-release component, wherein the ring portion has arced ring walls having convex and concave configurations. During sealing engagement with the drain rim, the ring portion is in the convex configuration. Pressure applied to the ring portion causes it to move to the concave configuration. The seal between the ring portion and the substrate is released, and the strainer can be readily removed from the drain opening for disposal without having to touch the strainer contents.

6 Claims, 6 Drawing Sheets

DISPOSABLE SINK DRAIN STRAINER

CROSS-REFERENCE TO RELATED APPLICATIONS

This application is a continuation-in-part of U.S. patent application Ser. No. 11/440,760, which was filed on May 25, 2006, now U.S. Pat. No. 7,442,296 the disclosure of which is hereby incorporated by reference.

BACKGROUND OF THE INVENTION

1. Field of the Invention

The present invention relates to sink drain strainers appointed to be used in conjunction with a drain opening of a plumbing fixture; and more particularly, to a disposable sink drain strainer that forms a substantially watertight seal along a substrate adjacent the drain perimeter and is readily released from substantial sealing engagement with the substrate for convenient disposal of the strainer contents.

2. Description of the Prior Art

Strainer devices for sink drains are commonly utilized for preventing debris from entering drains of kitchen, bathroom, and shower or bath plumbing fixtures. These devices require frequent cleaning as debris accumulates causing fluid passage through the strainer to be slowed and, consequently, water back up and slowed drainage from the sink. Moist environments inherent to plumbing fixtures aggregated with accumulation of food particles and other debris creates an ideal breading ground for bacterial growth within the debris itself, the drain strainer/filter, sink, and overall plumbing.

Cleaning of these devices is often an undesirable task, and can be difficult in removing entangled debris therefrom without intimate contact with the debris. In addition, removal of a strainer from the sink can be cumbersome particularly when the strainer is moistened from water and heavy with debris. Handling of the debris filled strainer in removal of the debris exposes the handler to harmful bacteria. Despite cleaning or removal of the debris placement of the contaminated strainer back in the drain can be unsanitary, and in addition, many times small amounts of stubborn debris remain entangled in the apertures of the strainer. Remaining debris entrapped in the strainer can result in sink drainage problems, compound bacterial growth, and eventually wash through the strainer and clog the joints of domestic water and sewer lines.

Various types of strainer devices for plumbing fixtures attempt to attend to the aforementioned problems associated with debris accumulation, removal, and bacterial growth. However, none of these drain strainers or filters provide a simple, economically conducive, sanitary strainer composed of a flexible material, which can be readily removed from the sink and disposed of, thereby providing a more sanitary sink environment. Moreover, none of the drain strainers heretofore disclosed and utilized provides a ready release means so that the strainer or filter is removed from the drain with minimal effort.

Numerous sink drain strainers heretofore disclosed and utilized involve strainer devices generally integrated within plumbing fixtures. For example, U.S. Pat. No. 5,535,455 to Liu discloses a sink strainer for a garbage disposal unit, wherein the garbage disposal unit is integrated within a sink's plumbing. U.S. Pat. No. 5,397,464 to Hannon discloses a strainer basket disposed within a housing appointed to be integrated with piping of a plumbing fixture. U.S. Pat. No. 6,387,261 to Mojena discloses a filter device comprising first and second filtration elements, the first being disposable, and housed within a filter housing appointed to be mounted to a drain fixture. U.S. Pat. No. 4,045,351 to Peterson discloses a disposable mesh strainer received within a strainer holder housed within an elongated cylinder mounted beneath a sink and integrated within the plumbing thereof. Although the Mojena and the Peterson patents teach a disposable filter/strainer, both devices involve integration of the device's housing within a plumbing fixture, resulting in sink drain compatibility, installation and overall manufacturing costs. Moreover, accessing the strainer or filter element for cleaning or replacement can become cumbersome and time consuming.

Other heretofore disclosed and utilized drain strainers provide a strainer or filter that covers a substantial portion of a sink's bottom, and does not merely provide filtering or straining over the drain area. For example, U.S. Pat. No. 6,303,032 to Genduso discloses a portable multi-strainer sized to cover the entire bottom of a kitchen sink with a thin edge border adapted for a tight fit to the walls of the sink. The device does not provide a drain strainer appointed to fit upon a drain but instead provides a strainer that covers the entire bottom of a sink. In addition, the device is not disposable in nature, and is continuously reused. Debris must be cleaned from the device, and bacteria growth is likely promoted. The device does not provide a removal means, such as a tab or other release means.

Many of the heretofore disclosed and utilized drain strainer devices provide a strainer and plug combination wherein a strainer is appointed to be received by a drain opening and a plug is appointed to fit within the strainer. One example of these strainer and plug combination drain strainers is U.S. Pat. No. 6,601,242 to Rebischke, which discloses a flexible strainer and plug combination wherein the strainer has an annular ring appointed to engage arranged to form a seal with the plumbing fixture and a strainer portion appointed to engage a plug. Another example of a strainer and plug combination can be found at www.ImprovementsCatalog.com, under sink strainer/stopper, which offers a decorative sink strainer/stopper combination composed of a flexible thermoplastic material which comes in a variety of colors, and which is impregnated with an antibacterial agent. Contrastingly, U.S. Pat. No. 4,205,710 to Dunicz discloses a combination funnel and strainer device for disposing chemical waste and flushing liquid, such as water, down a sink drain. These devices are not disposable, and are instead continuously reused; therefore debris must be cleaned from these devices regularly. These devices do not provide a removal means, such as a tab or other release means, and as a result are inherently difficult to retrieve from the sink's drain.

Even where removal means and disposable strainers are utilized, there is no suggestion concerning a friction or press-release removal means. U.S. Pat. No. 5,376,264 to Betancourt discloses a drain trap apparatus comprising a support member semi-permanently attached around a drain opening and having an upper surface and a lower surface appointed to removably receive a disposable filter. U.S. Pat. No. 4,134,162 to Sharland et al. discloses a drain strainer having a vacuum cup defining a ring-shaped base and a generally conical shell appointed to receive a second generally conical shell that has drain openings and is disposable. U.S. Pat. No. 3,982,289 to Robbins discloses a disposable sink strainer generally comprising a strainer portion and a rim having means integrally connected therewith for disposal of the strainer.

Notwithstanding the efforts of prior art workers to construct a drain strainer for plumbing fixtures there remains a need in the art for a disposable drain strainer that can sealingly engage a drain rim and is released from sealing engagement by application of friction or pressure, thereby effecting ready removal of the strainer from the drain. In addition, there is a need in the art for a lightweight, economical, sanitary strainer composed of a flexible material that can be readily removed from the sink and disposed of, thereby providing a more sanitary sink environment. Moreover, there is a need in the art for a drain strainer that provides a ready release means so that the strainer or filter is removed from the drain with minimal effort.

SUMMARY OF THE INVENTION

The present invention provides a lightweight, disposable drain strainer that can substantially sealingly engage a drain rim, and is readily released from sealing engagement with the rim by application of friction or pressure. Composed of a flexible material, such as plastic, the strainer is economical to construct. It can be readily removed from the sink and disposed of, thereby providing a more sanitary sink environment. A ready release means facilitates removal of the strainer from the drain with minimal effort.

More specifically, the invention provides a disposable drain strainer that can be readily placed in a drain to effect substantially sealing engagement with the drain perimeter, so that debris is retained by the strainer while water and other fluids pass therethrough. When the disposable drain strainer is filled with debris, the seal is disengaged by depressing a seal release means. Upon removal from the drain, the strainer device can be readily discarded. The disposable drain strainer further comprises a strainer portion removably received within a drain opening having an adjacent drain rim substrate. A ring portion and a seal release means cooperate to effect sealing engagement between the strainer and substrate, and to release the strainer from the substrate by application of friction or pressure.

The disposable drain strainer device for use in conjunction with a drain opening comprises a strainer portion comprising strainer walls and a strainer bottom. The strainer portion has a plurality of small apertures therein. It is removably received within the drain opening so that a ring portion of the strainer contacts a substrate adjacent to the drain rim. The ring portion is fixedly attached to the walls of the strainer portion. It has a top and bottom surface, and is constructed and arranged to engage with and form a seal with the adjacent drain rim substrate of the drain opening. A seal release means integral with the ring portion takes the strainer out of sealing engagement with the substrate.

In one embodiment, the seal release means comprises a tab pivotally and fixedly attached by a connection means to the top surface of the ring portion. The tab further comprises an interior and an exterior surface. Optionally, a friction coating may be fixed to the tap to facilitate easy grasping thereof. In another embodiment, the seal release means comprises a press-release integral with the ring portion. In this embodiment, the walls of the ring have a convex configuration. The convex configuration of the ring walls enables the ring portion to form a seal with the adjacent drain rim substrate. Upon application of pressure, the ring portion assumes a concave configuration. The seal is released and the disposable drain strainer device is removed from the drain opening and discarded.

Preferably, the disposable drain strainer is composed of a polymeric material. The polymeric material may be selected from the group consisting of Polyethylene (PE), Polypropylene (PP), Polyethylene Terephthalate (PET or PETE). The disposable drain strainer device preferably has a thickness no greater than 0.091 cm (0.036 inch). This thickness limitation and polymeric material composition yields a lightweight, economically viable, yet sturdy, disposable strainer product.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention provides to a disposable drain strainer for use in conjunction with a drain opening. The disposable drain strainer can be readily placed in a drain to form a seal with an adjacent substrate surrounding the drain, causing debris to be retained in by the strainer while water and other fluids pass therethrough. When the disposable drain strainer is filled with debris, the seal is disengaged using a seal release means, and the strainer is readily discarded. The disposable drain strainer generally comprises a strainer portion removably received within a drain opening having an adjacent drain rim area, a ring portion, and a seal release means, which in one embodiment comprises a tab and in another embodiment comprises a press-release integrated within the ring portion.

Figure 1A:
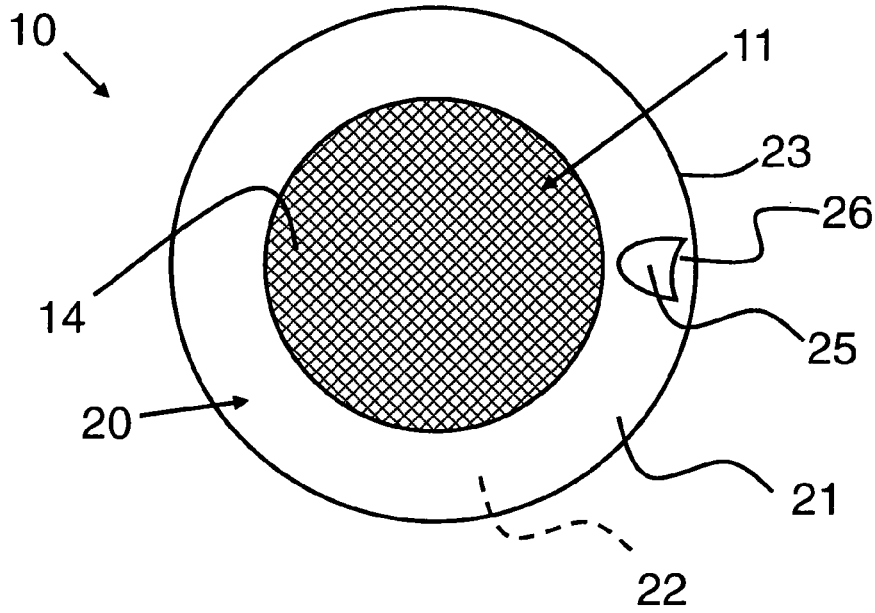
FIG. 1*a* illustrates a top planer view of a first embodiment of the disposable drain strainer with the seal release mean's tab appointed to be grasped by a person's fingers pivotally and fixedly attached to the ring portion.
Figure 1B:
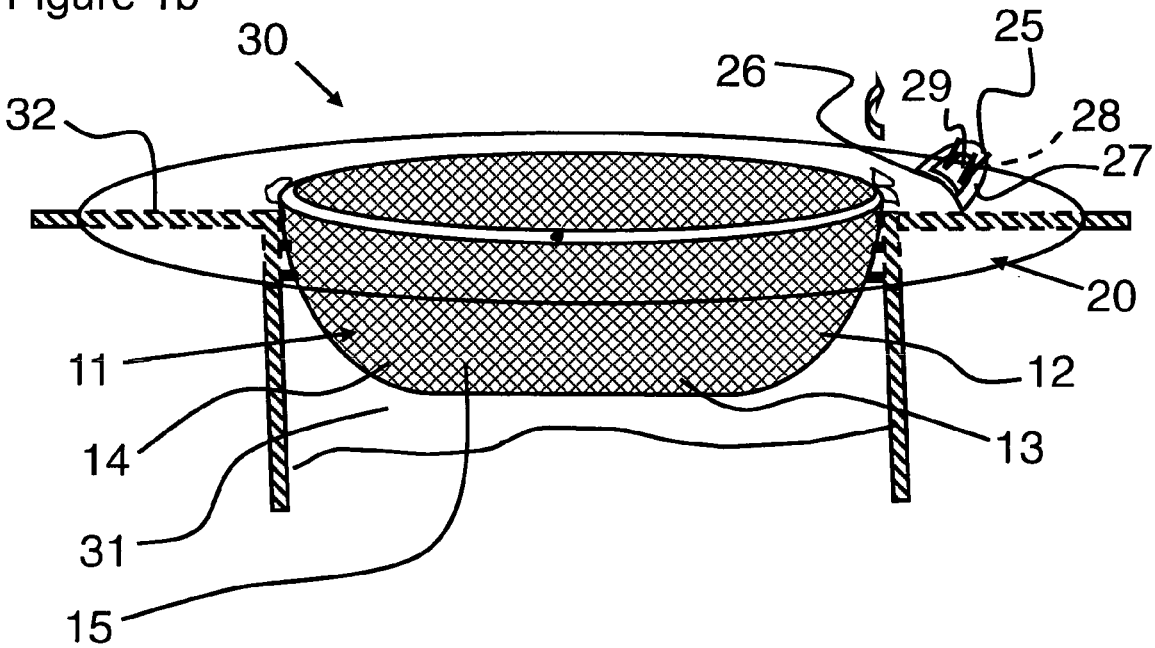
FIG. 1*b* illustrates a side view of the disposable drain strainer disposed in a drain and wherein the seal release mean's tab pivotally and fixedly attached to the ring portion includes an inner aperture fixed therein to facilitate easy grasping of the tab by a person.

FIGS. 1*a* and 1*b* illustrate a first embodiment of the disposable drain strainer showing the seal release mean's tab appointed to be grasped by a person's fingers pivotally and fixedly attached to the ring portion. FIG. 1*a* is a top planar view of the strainer, shown generally at 10. FIG. 1*b* is a top side view wherein the disposable drain strainer, shown generally at 30, is received in a drain and wherein the seal release mean's tab pivotally and fixedly attached to the ring portion includes an inner aperture fixed therein to facilitate easy grasping of the tab by a person. The disposable drain strainer 10, 30 comprises a strainer portion 11 comprising strainer walls 12 and a strainer bottom 13. The strainer portion 11 is provided with a plurality of small apertures 14 in the strainer walls 12 and strainer bottom 13. The plurality of small apertures 14 are of a size and shape sufficiently small that debris are prevented from passing beyond the drain opening 31 and into the drain pipe, while drainage water 33 is allowed to pass through the accumulated debris and apertures 14. Preferably, these pluralities of small apertures 14 range in diameter between 0.1 cm to 0.3 cm, and most preferably at 0.2 cm in diameter. Optionally, the plurality of small apertures each have a slightly tapered configuration with sloped walls, wherein the top of the apertures is wider than the bottom of the aperture so that smaller food particles pass the top of the aperture but are trapped nearer the bottom of the aperture where the aperture is tapered.

Strainer portion 11 is removably received within a drain opening 31 having an adjacent drain rim area 32. The drain is preferably a kitchen sink drain or rinse basin, or the like, affixed to a plumbing fixture. The drain may be a bathroom sink drain or shower or tub drain. The size of the disposable drain strainer can vary to accommodate a vast array of sink drain sizes, shapes, and depths. Preferably, strainer walls 12 of strainer portion 11 extend and engage with strainer bottom 13 to form strainer containment well 15 having a depth ranging between 0.1 (0.039 inches) to 4 cm (1.57 inches). Strainer containment well 15 has a depth sufficient to receive debris therein.

The disposable drain strainer 10, 30, further comprises ring portion 20 fixedly attached to strainer walls 12 of strainer portion 11. Ring portion 20 further comprises a top surface 21 and bottom surface 22. Ring portion 20 is constructed and arranged to engage with and form a seal with adjacent drain rim area 32 of drain opening 31. This seal between ring portion 20 and adjacent drain rim area 32 substantially prevents the seepage and passage of wayward debris from bypassing strainer portion 11 and undesirably entering drain opening 31 and potentially clogging the plumbing piping. Optionally, ring portion 20 further comprises a seal gasket (see FIGS. 3*a* and 3*b*) or a suction-cup gasket (see FIGS. 4*a*-4*c*).

The disposable drain strainer 10, 30, further comprises a seal release means, herein shown as tab 25, integrated within ring portion 20. In this embodiment, shown at 10 and 30, seal release means comprises a tab 25 pivotally and fixedly attached to the top surface 21 of ring portion 20 by way of a connection means 26. Preferably, tab 25 is connected to ring portion 20 so that the connection means 26 is located closer to the outside perimeter 23 of ring portion 20, and the tab opens as indicated by way of the arrow. Tab 25 comprises an interior surface 27 and an exterior surface 28. Interior surface 27 is in intimate contact with top surface 21 of ring portion 20 when tab 25 is in the closed configuration, as illustrated at 10 in FIG. 1*a*. When tab 25 is in the open configuration, the area between interior surface 27 and top surface 21 of ring portion 20 becomes great, so that tab 25 can pivot 180° on top surface 21.

Continuing with FIGS. 1*a* and 1*b*, optionally, interior surface 27 and exterior surface 28 of tab 25 have a friction coating fixed thereon to facilitate easy grasping of tab 25 by an individual. This friction coating provides enhanced grasping that enables the user to apply enough force to break the seal and remove the disposable strainer 10, 30, from the drain 31, while mitigating slippage of the fingers. This friction coating feature is especially advantageous, as debris and moisture or water droplets on tab 25 tend to cause a slippery grasp, which can heighten the difficulty of breaking the seal and removing a debris laden strainer. Alternatively, the interior surface 27 of tab 25 has a friction coating fixed thereon to facilitate easy grasping of tab 25; and exterior surface 28 does not include the friction coating. Optionally, tab 25 has an inner aperture 29 fixed therein to facilitate easy grasping of tab 25 by the user.

Figure 2A:
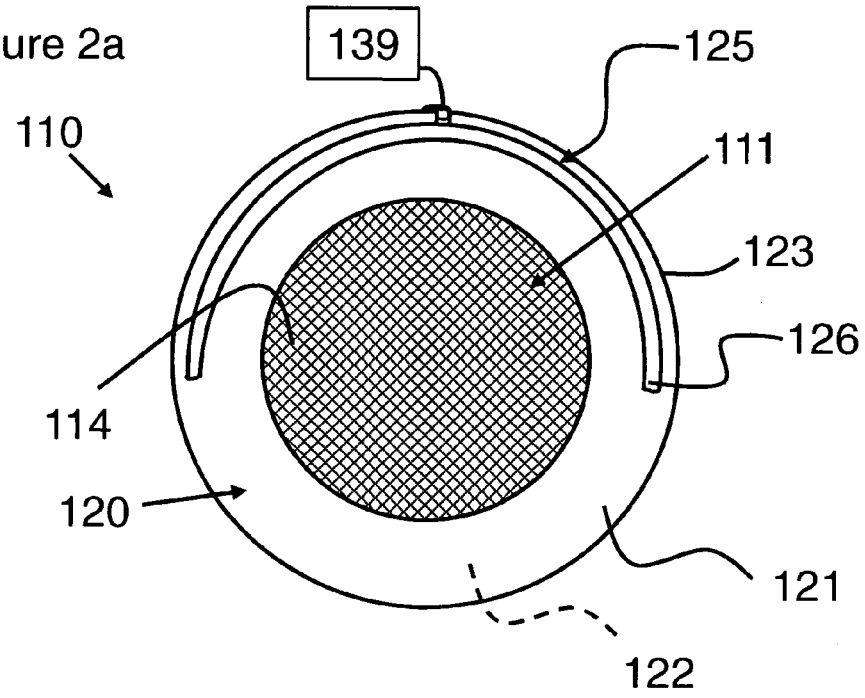
FIG. 2*a* illustrates a top planer view of an embodiment of the disposable drain strainer with the seal release mean's tab is configured as an arc tab that is semicircular expanding circumferentially around half of the ring portion and is pivotally and fixedly attached to the top surface of the ring portion by a connection means, wherein the arc tab is in a flat configuration as when the disposable drain strainer is in use in a sink.
Figure 2B:
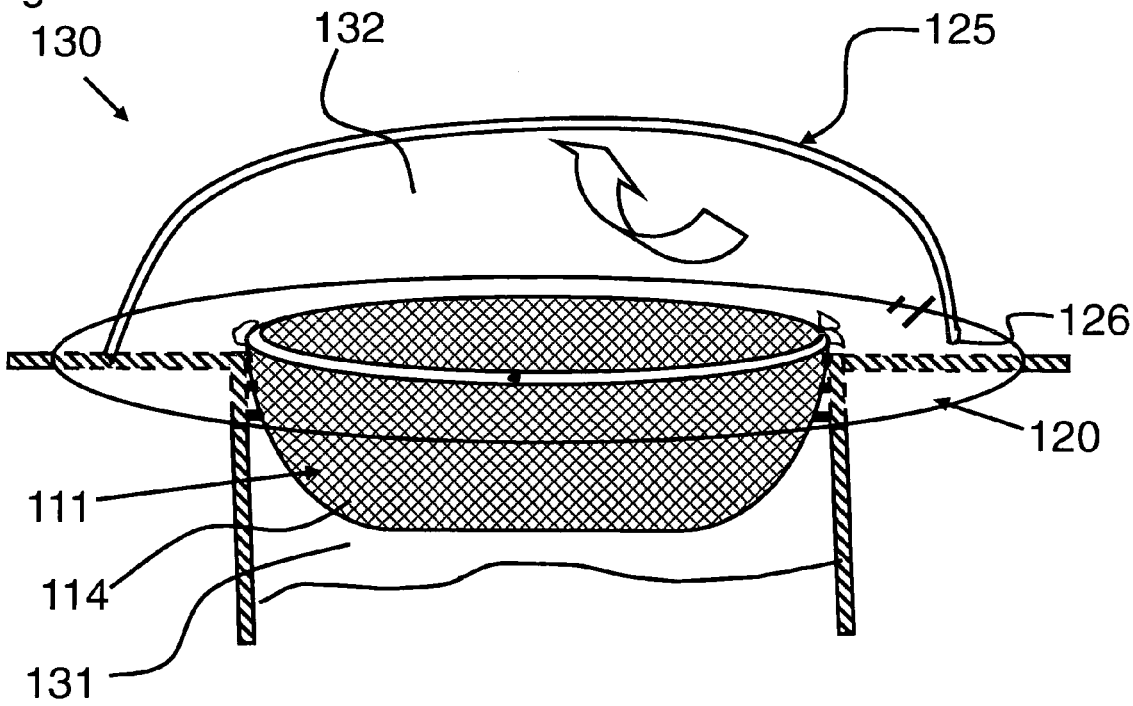
FIG. 2*b* illustrates a side view of the disposable drain strainer show in FIG. 2*a*, wherein the arc tab is lifted upward as when the disposable drain strainer is ready to be removed from the sink.

FIGS. 2*a* and 2*b* illustrate a variation of the first embodiment of the disposable drain strainer, as shown in FIGS. 1*a* and 1*b*, but herein the tab comprises an arc tab that is semicircular and expands circumferentially around half of the ring portion and is pivotally and fixedly attached to the top surface of the ring portion by a connection means. FIG. 2*a* illustrates a top planer view wherein the arc tab is in a flat configuration as when the disposable drain strainer is in use in a sink, shown generally at 110. FIG. 2*b* illustrates a top-side view of the disposable drain strainer wherein the arc tab is lifted upward as when the disposable drain strainer is ready to be removed from the sink, shown generally at 130. The disposable drain strainer 110, 130 comprises a strainer portion 111 provided with a plurality of small apertures 114. Strainer portion 111 is removably received within a drain opening 131. The disposable drain strainer 110, 130, further comprises ring portion 120 having a top surface 121 and bottom surface 122 equipped with a seal release means, herein shown as tab 125. In this embodiment, tab 125 is configured as an arc tab that is semicircular expanding circumferentially around half of ring portion 120 and is pivotally and fixedly attached to top surface 121 of ring portion 120 by a connection means 126. Arc tab/tab 125 further comprises an inner arc aperture 132 (best seen in FIG. 2*b* with the arc tab/tab 125 in the upward position) so that when arc tab/tab 125 is pivoted from top surface 121 of ring portion 120 and is rotated in an upward manner arc tab 125 forms a handle configuration, as shown in FIG. 2*b* at 133, for easy removal of disposable drain strainer 110, 139 from drain opening 131 and for convenient carrying to a trash can for disposal. Ring portion 120 further has a rim 123, which may engage with a fastening mechanism or snap mechanism 139 attached to arc tab/tab 125 to ensure arc tab 125 remains in the folded condition while being used in drain opening 131. Preferably, arc tab/tab 125 sits in a groove located on top surface 121 of ring portion 120.

Figure 3A:
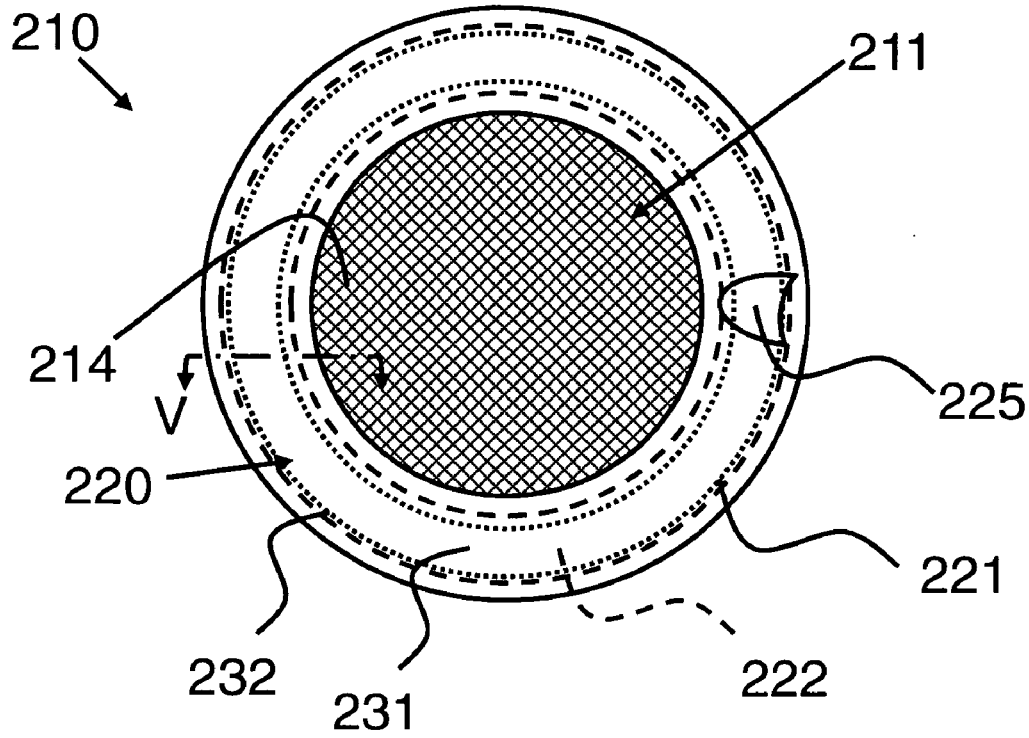
FIG. 3*a* illustrates a top view of an embodiment of the disposable drain strainer wherein the ring portion further comprises a seal gasket located on the bottom surface of said ring portion.
Figure 3B:
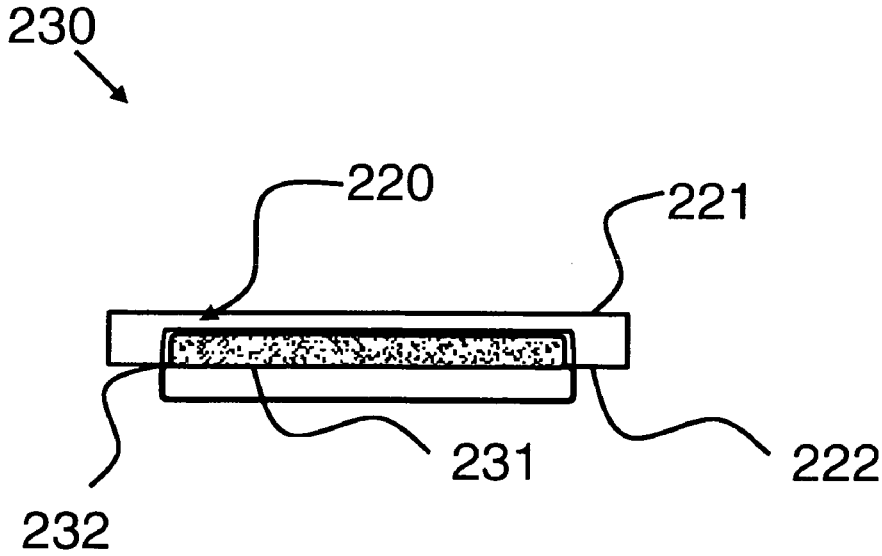
FIG. 3*b* illustrates a cross-sectional side view taken along line V of FIG. 3*a*, showing the seal gasket located on the bottom surface of said ring portion.

FIGS. 3*a* and 3*b* illustrate views of an embodiment of the disposable drain strainer wherein the ring portion further comprises a seal gasket located on the bottom surface of the ring portion. FIG. 3*a* shows a top view at 210, while FIG. 3*b* shows a cross-sectional side view taken along line V of FIG. 3*a* at 230. Disposable drain strainer 210, 230 comprises a strainer portion 211 provided with a plurality of small apertures 214, a ring portion 220 having a top surface 221 and bottom surface 222 equipped with a seal release means, herein shown as tab 225. Ring portion 220 further comprises a seal gasket 231 located on bottom surface 222. Preferably, seal gasket 231 is housed in a groove 232 integrated within bottom surface 222 of ring portion 220. Ring portion 220 is constructed and arranged to engage with and form a seal with the adjacent a drain rim area of a drain opening of a sink as facilitated by seal gasket 231 to substantially prevent the seepage and passage of wayward debris from bypassing strainer portion 211 and undesirably entering the drain opening and potentially clogging the plumbing piping.

Figure 4A:
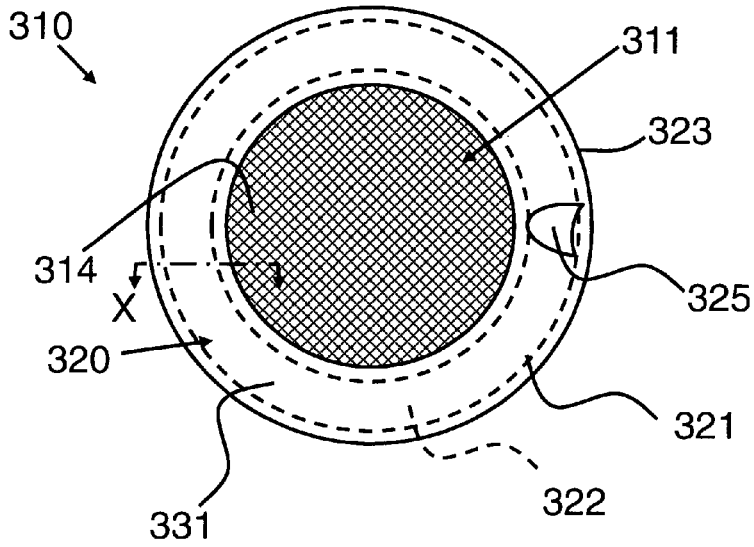
FIG. 4*a* illustrates a top view of an embodiment of the disposable drain strainer wherein the ring portion further comprises a suction-cup gasket located on the bottom surface of said ring portion.
Figure 4B:
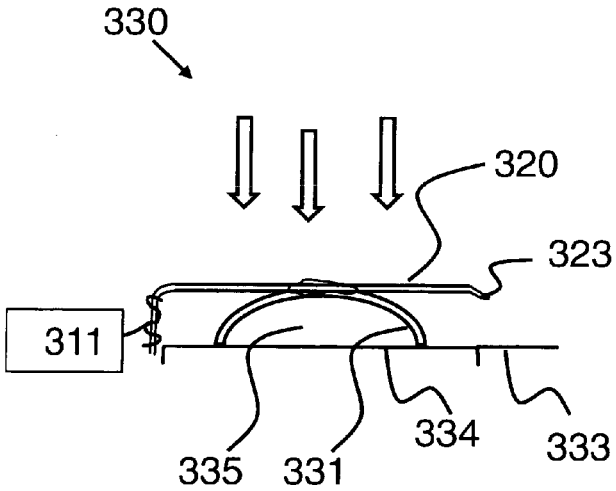
FIG. 4*b* illustrates a cross-sectional side view taken along line X of FIG. 4*a*, showing the suction-cup gasket in the non-deformed or non-sealed condition, such as before applying pressure to the ring portion to from the seal.
Figure 4C:
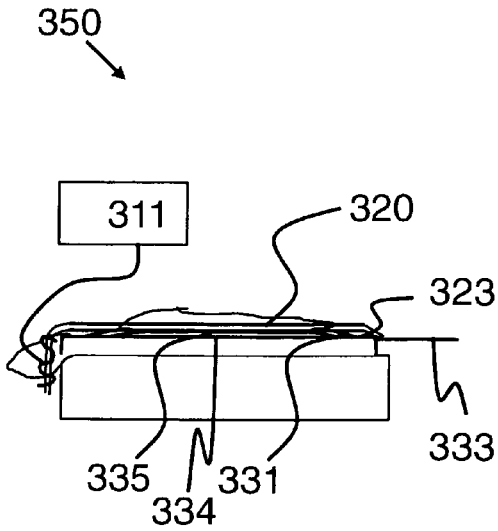
FIG. 4*c* illustrates a cross-sectional side view taken along line X of FIG. 4*a*, showing the suction-cup gasket in the deformed or sealed condition, such as after applying pressure to the ring portion to from the seal.

FIGS. 4*a*-4*c* illustrate views of an embodiment of the disposable drain strainer wherein the ring portion further comprises a suction-cup gasket located on the bottom surface of said ring portion. FIG. 4*a* shows a top view at 310, FIG. 4*b* shows a cross-sectional side view taken along line X of FIG. 4*a* at 330 wherein the suction-cup gasket in the non-deformed or non-sealed condition, such as before applying pressure to the ring portion to from the seal, and FIG. 4*c* shows the cross-sectional at 350 wherein the suction-cup gasket in the deformed or sealed condition, such as after applying pressure to the ring portion to from the seal. Disposable drain strainer 310 comprises a strainer portion 311 provided with a plurality of small apertures 314, a ring portion 320 having a top surface 321 and bottom surface 322 equipped with a seal release means, herein shown as tab 325. Ring portion 320 further comprises a suction-cup gasket 331 located on bottom surface 322. Preferably, suction-cup gasket 331 is a ring formation aligned with ring portion 320 and fixed to bottom surface 322 thereof. Suction-cup gasket 331 is formed having a cup like structure (which is elongated and in a ring formation) having an area space 335 that when pressed becomes deformed (as shown at 350) compressing air from area space 335 to substantially deform same to form a seal between a sink perimeter 334 of a sink basin 333 and ring portion 320. Further, preferably ring portion 320 includes an angled edge or rim 323 so that same lies substantially flush with sink perimeter 334 and/or sink basin 333. Thus, ring portion 320 is constructed and arranged to engage with and form a seal with the adjacent a drain rim area of a drain opening of a sink as facilitated by suction-cup gasket 331 to substantially prevent the seepage and passage of wayward debris into the drain.

Figure 5A:
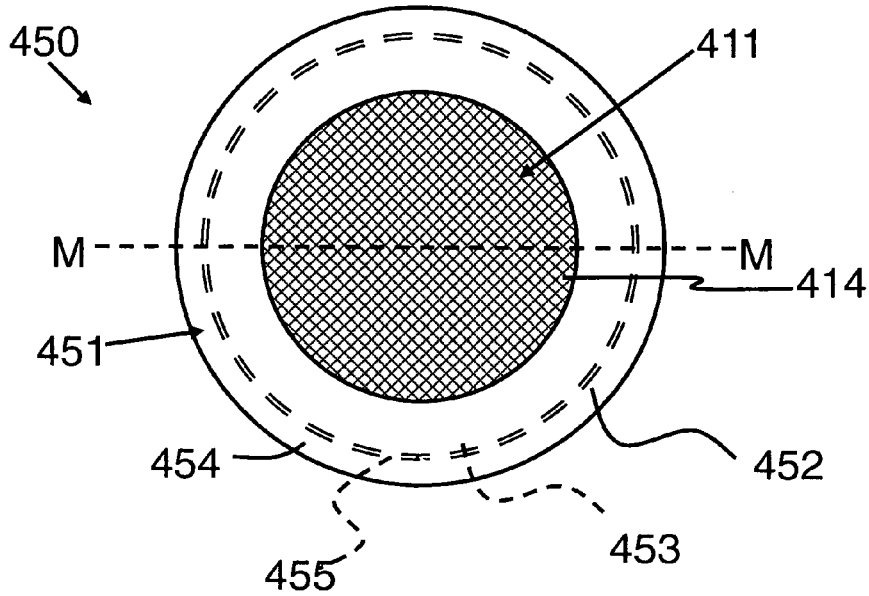
FIG. 5*a* illustrates a top planer view of another embodiment of the disposable drain strainer wherein the seal release means comprises a press-release integrated within the ring portion.
Figure 5B:
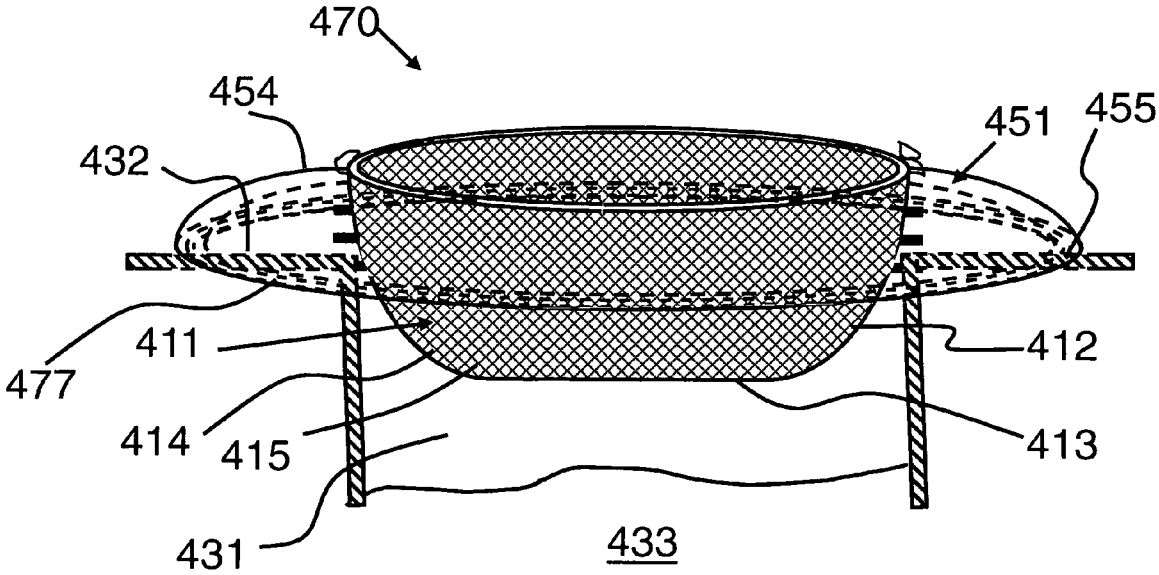
FIG. 5*b* illustrates a side view of the disposable drain strainer of FIG. 5*a* disposed in a sink.

FIGS. 5*a* and 5*b* illustrate an embodiment of the disposable drain strainer wherein the seal release means comprises a press-release integrated within said ring portion. FIG. 5*a* is a top planar view in which the strainer is shown generally at 450. FIG. 5*b* is a side view wherein the disposable drain strainer, shown generally at 470, is received in a drain. In this embodiment of the disposable drain strainer 450, 470, the seal release means comprises a press-release integrated within a ring portion 451 so that ring portion 451, having top surface 452 and bottom surface 453 further comprises arced ring walls 454 having convex and concave configurations. These arched ring walls are depicted at 501 and 502 in FIGS. 6*a*, 6*b*, and 6*c* and will be described hereinafter in greater detail. The disposable drain strainer 450, 470, comprises a strainer portion 411 comprising strainer walls 412 and a strainer bottom 413. The strainer portion 411 is appointed with a plurality of small apertures 414 in the strainer walls 412 and strainer bottom 413 to form strainer containment well 415. The plurality of small apertures 414 may each have slightly tapered, sloped walls. Strainer portion 411 is removably received within drain opening 431 having an adjacent drain rim area 432.

Figure 6A:
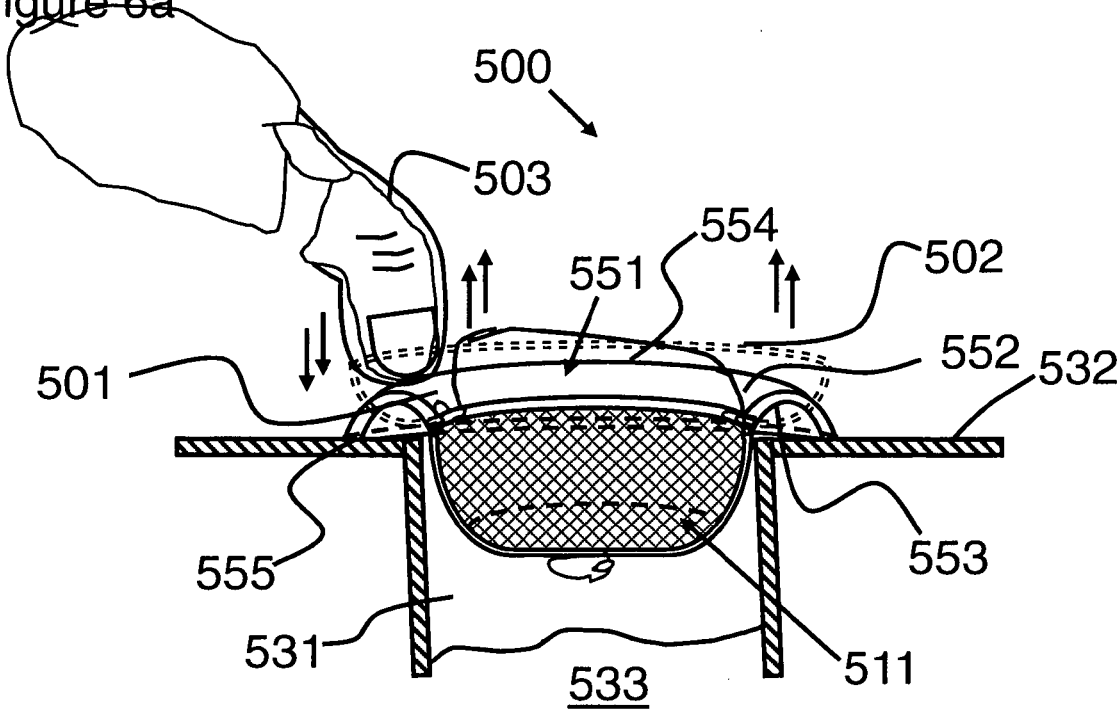
FIG. 6*a* illustrates a planer view taken along line M of FIG. 5*a*, showing engagement and disengagement from a sealed condition by moving the ring wall between convex and concave configurations to achieve a press-release.
Figure 6B:
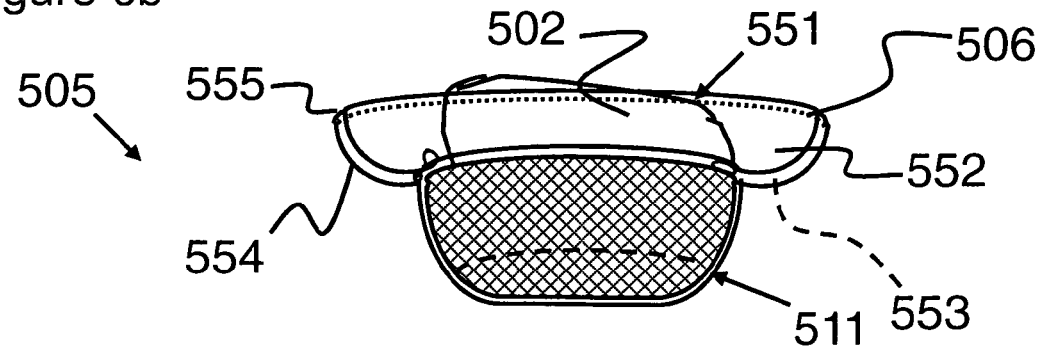
FIG. 6*b* illustrates a planer view taken along line M of FIG. 5*a*, showing the rim portion in the concave configuration.
Figure 6C:
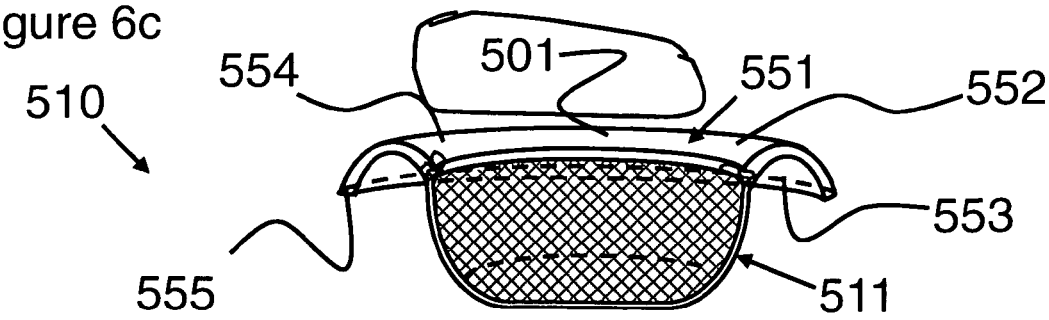
FIG. 6*c* illustrates a planer view taken along line M of FIG. 5*a*, showing the rim portion in the convex configuration.

Continuing with FIGS. 5*a* and 5*b*, the disposable drain strainer 450, 470, ring portion 451 fixedly attached to strainer walls 412 of strainer portion 411 is appointed with arced ring walls 454 having convex and concave configurations (shown in FIGS. 6*a*, 6*b*, and 6*c*). Arced ring walls 454 further comprise a ring edge/sealing rim 455 that engages with and forms a seal with adjacent drain rim area 432 of drain opening 431. This seal between sealing rim 455 of ring portion 451 and adjacent drain rim area 432 prevents the seepage and passage of wayward debris from bypassing strainer portion 411 and undesirably entering drain opening 31 and potentially clogging the drain piping. Sealing rim 455 may further comprise a seal gasket 477 (best seen in FIG. 5*b*) located on the bottom surface thereof. Preferably, the disposable drain strainer device has a thickness no greater than 0.2 cm (0.079 inch). Also, preferably, the disposable drain strainer is composed of a rubber material. Most preferably the disposable drain strainer is composed of a polymeric material selected from the group consisting of Polyethylene (PE), Polypropylene (PP), or Polyethylene Terephthalate (PET or PETE).

FIGS. 6*a*, 6*b*, and 6*c* illustrate the disposable drain strainer of FIG. 5*a* taken along line M, wherein the seal release means comprises a press-release integrated within said ring portion. FIG. 6*a* illustrates a planer view taken along line M in FIG. 5*a* showing engagement and disengagement of the convex and concave configurations by way of a press-release, shown generally at 500. FIG. 6*b* illustrates a planer view taken along line M of FIG. 5*a*, showing the rim portion in the concave configuration, shown generally at 505. FIG. 6*c* illustrates a planer view taken along line M of FIG. 5*a*, showing the rim portion in the convex configuration, shown generally at 510. In this embodiment, as shown generally in FIGS. 6*a* and 6*b*, the seal release means comprises a press-release integrated within ring portion 551. Ring portion 551 further comprises arced ring walls 554 having convex 501 and concave 502 (shown in phantom) configurations. Ring portion 551 having top surface 552 and bottom surface 553 and arced ring walls 554 is fixedly attached to strainer portion 511. Strainer portion 511 is removably received within drain opening 531, which has an adjacent drain rim substrate 532.

Continuing with FIGS. 6*a*, 6*b*, and 6*c*, the disposable drain strainer 500, 505, 510, ring portion 551 and arced ring walls 554 further comprise a sealing rim 555 that engages with and forms a seal with adjacent drain rim area 532 of drain opening 531. This seal between sealing rim 555 of ring portion 551 and adjacent drain rim area 532 prevents the seepage and passage of wayward debris from bypassing strainer portion 511 and undesirably entering drain opening 531 and potentially clogging the drain piping. Convex configuration 501 is engaged when ring portion 551 forms the seal with adjacent drain rim area 532. Concave configuration 502 is engaged when top portion 552 of ring portion 551 is pressed, for example by thumb or finger 503. As force is applied to top portion 552 by thumb 503, and the concave configuration 502 results, the seal between ring portion 551 and adjacent drain rim substrate 532 is broken. The concave configuration 502 results in upturned portions 506, which are readily grabbed by the individual. Using these upturned portions the disposable strainer device 500, 505, and 510 is readily removed from the drain and discarded by the user without having to touch the strainer contents.

Preferably, the disposable drain strainer device is composed of a polymeric material. The polymeric material may be selected from the group consisting of Polyethylene (PE), Polypropylene (PP), or Polyethylene Terephthalate (PET or PETE). The disposable drain strainer device preferably has a thickness no greater than 0.091 cm (0.036 inch). This thickness limitation and polymeric material composition yields a lightweight, economically viable, yet sturdy disposable strainer product. A thickness of no greater than 0.091 cm enables a disposable strainer to carry a load of debris without strainer breakage. Moreover, a thickness of no greater than 0.091 cm provides the ability to closely pack, ship, and distribute the disposable strainers in a cost effective manner, since many of the disposable strainers can be readily stacked upon one another during shipment and storage, and points of sale. In addition, cost saving benefits can be reaped through savings in raw materials (i.e. less materials being utilized for the thin strainers), production costs, reduced need for solvents and decreased generation of hazardous waste during manufacture.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A disposable drain strainer for use with a drain opening having an adjacent drain rim substrate, comprising:

a. a strainer portion comprising strainer walls and a strainer bottom, said strainer portion having a plurality of small apertures therein and adapted to be removably received within said drain opening;

b. a ring portion fixedly attached to said strainer walls of said strainer portion, said ring portion having top and bottom surfaces and being adapted to substantially sealingly engage said drain rim substrate; and c. a seal release means integral within said ring portion for facilitating release of said ring portion and removal of said strainer from said drain;

d. said seal release means comprising a press-release integrated within said ring portion so that said ring portion further comprises arced ring walls having convex and concave configurations with a ring edge, wherein said convex configuration is engaged when said ring portion forms said seal with said adjacent drain rim area, and wherein said concave configuration is engaged when said top portion of said ring portion is pressed, said seal being released and said disposable drain strainer being removed from said drain opening and discarded.

2. A disposable drain strainer as recited by claim 1, wherein said ring edge of said portion further comprises a seal gasket located on said bottom surface of said ring portion.

3. A disposable drain strainer as recited by claim 1, wherein said disposable drain strainer device has a thickness no greater than 0.2 cm (0.079 inch).

4. A disposable drain strainer as recited by claim 1, wherein said disposable drain strainer is composed of a rubber material.

5. A disposable drain strainer as recited by claim 1, wherein said disposable drain strainer is composed of a polymeric material selected from the group consisting of Polyethylene (PE), Polypropylene (PP), or Polyethylene Terephthalate (PET or PETE).

6. A disposable drain strainer as recited by claim 1, wherein said plurality of small apertures each have slightly tapered, sloped walls.

* * * * *